US007490829B2

(12) United States Patent
Heemskerk

(10) Patent No.: US 7,490,829 B2
(45) Date of Patent: Feb. 17, 2009

(54) SHEET REGISTRY DEVICE

(75) Inventor: Ronald T. C. Heemskerk, Grubbenvorst (NL)

(73) Assignee: Oce-Technologies B.V., Venlo (NL)

( * ) Notice: Subject to any disclaimer, the term of this patent is extended or adjusted under 35 U.S.C. 154(b) by 0 days.

(21) Appl. No.: 11/599,366

(22) Filed: Nov. 15, 2006

(65) Prior Publication Data

US 2007/0108699 A1 May 17, 2007

(30) Foreign Application Priority Data

Nov. 16, 2005 (NL) ..... 1030437

(51) Int. Cl.
*B65H 9/16* (2006.01)

(52) U.S. Cl. ..... 271/250; 271/251

(58) Field of Classification Search ..... 271/250, 271/251, 239, 303

See application file for complete search history.

(56) References Cited

U.S. PATENT DOCUMENTS

| | | | |
|---|---|---|---|
| 3,148,877 | A | 9/1964 | Brearley |
| 4,334,759 | A | 6/1982 | Clausing |
| 6,460,844 | B1 | 10/2002 | Clifford et al. |
| 6,695,302 | B1 | 2/2004 | Lamothe |

FOREIGN PATENT DOCUMENTS

| | | | |
|---|---|---|---|
| EP | 0386278 | A | 9/1990 |
| EP | 1469358 | A2 | 10/2004 |
| JP | 59-22851 | A | 2/1984 |
| JP | 59022851 | A | 2/1984 |
| JP | 2004-161387 | A | 6/2004 |
| KR | 2760733 | A1 | 12/1997 |

*Primary Examiner*—David H Bollinger
(74) *Attorney, Agent, or Firm*—Birch, Stewart, Kolasch & Birch, LLP

(57) ABSTRACT

A sheet processing device wherein sheets are deposited in a staggered configuration relative to one another, which includes a paper path, a first and second sheet edge guide fitted substantially parallel to one another in the feed-through direction, and a transportation device arranged to convey a sheet through the paper path in the feed-through direction and the lateral direction, where the first and second sheet edge guides are arranged statically relative to the paper path and in a staggered configuration relative to one another in the lateral direction, and a switchable control mechanism is fitted to adopt a first and second configuration, allowing a sheet edge to be conveyed into respective first and second sheet edge guides during operation.

7 Claims, 6 Drawing Sheets

SHEET REGISTRY DEVICE

This application claims priority under 35 U.S.C. § 119(a) on patent application Ser. No. 1030437 filed in The Netherlands on Nov. 16, 2005, the entire contents of which is hereby incorporated by reference.

BACKGROUND OF THE INVENTION

The present invention relates to a sheet processing device wherein sheets may be deposited in a staggered configuration relative to one another, which comprises a paper path, a first and second sheet edge guide fitted substantially parallel to one another in the feed-through direction, and a transportation device arranged to convey a sheet through the paper path in the feed-through direction and the lateral direction. The present invention also relates to a post-processing station comprising a sheet processing device of this kind.

A sheet registering device is known from U.S. Pat. No. 4,334,759. This known device comprises a movable registration panel onto which a sheet is conveyed by a transportation device during operation, which conveys the sheet in both the feed-through direction and the lateral direction. When a sheet is to be registered in another configuration, the registration panel is conveyed to the new required configuration. A disadvantage of a device of this kind is the setting time required to convey the registration panel from the first configuration to a second configuration. The registration panel must remain stationary until the sheet has reached the exit point, whereas a new sheet cannot be conveyed against the registration panel until the registration panel has adopted a second configuration. As a result, productivity is lost at the level of the sheet processing device. A second disadvantage of a device of this kind is its limited reliability. As the device includes a movable registration panel, errors may occur in the movement or the accuracy of the movement during operation. This may, for example, result in a sheet jamming under the movable panel or in sheets aligning incorrectly relative to one another.

SUMMARY OF THE INVENTION

The object of the present invention is to obtain a sheet processing device wherein sheets are accurately stacked in a productive and reliable manner, in a staggered configuration relative to one another. To this end, a device has been invented wherein the first and second sheet edge guides are arranged statically relative to the paper path and in a staggered configuration relative to one another in the lateral direction, and a switchable control mechanism is utilized which can adopt a first and second configuration, allowing a sheet edge to be conveyed into the first and second sheet edge guides, respectively, during operation.

In one device according to the present invention, sheets following one another in quick succession may be conveyed into the first and second sheet edge guides without losing productivity due to the setting time of the registration panel. The fact that a sheet may be conveyed into the first or second sheet edge guide by a control mechanism eliminates the need for complicated, error-sensitive control devices to convey the registration panel to a new configuration.

The fact that only the edge of a sheet is conveyed into a first or second sheet edge guide eliminates the need for complicated, dual transportation devices to convey the sheet from the entry point to the exit point of the sheet processing device. The fact that only one transportation device is fitted at the level of the paper path allows a sheet, whichever sheet edge guide its edge is located in, to be conveyed in both the feed-through direction and the lateral direction.

A device according to the present invention may be used in any application in which incoming sheets are to be stacked in a staggered configuration relative to one another. The device according to the present invention may be used particularly conveniently in a post-processing device which may be mounted behind a printer to feed printed sheets onto a stack in a staggered configuration relative to one another.

In one embodiment according to the present invention, the control mechanism comprises a movable flap fitted at the level of the entry point to the paper path. This embodiment is convenient, as a movable flap may be operated quickly and reliably, partly due to its relatively minor mass to be conveyed. This allows a flap to be switched accurately from one configuration to another without losing productivity. A movable flap may easily be added near the entry point to the sheet processing unit in order to convey the edge of an incoming sheet into the first or second sheet edge guide, these sheet edge guides being fitted in a staggered configuration relative to one another in the lateral direction.

In another embodiment according to the present invention, the transportation device comprises at least a driven wheel configured such that the drive direction is at an angle of 0-90° to the feed-through direction in the paper path plane.

This embodiment is convenient, as a transportation device delivers a driving force in this way, with a component in both the transportation direction and the lateral direction, thus allowing the sheet to be conveyed in both the transportation direction and the direction of the registration panel during operation.

In a further embodiment according to the present invention, the driven wheel has a bend rigidity in the lateral direction such that the driven wheel bends outwards during operation when a sheet lying beneath touches the registration panel.

This embodiment is convenient, as a driving operation effected in this manner will prevent a sheet from striking the registration panel with excessive force and potentially damaging the sheet as a result of e.g., colliding or creasing. The choice of the lateral bend rigidity and friction force of the driven wheel also eliminates the need for the driving operation to be actively monitored to prevent damage by interrupting the lateral driving operation when the sheet touches the registration panel.

In one embodiment according to the present invention, the sheet edge guide is shaped in a U profile. A profile of this kind is easy to achieve, where the radius of the sheet edge guide panel may be monitored -properly at the closed side of the profile.

A U profile of this kind may, for example, be achieved by bending a flat plate, where the radius at the level of the registration panel must not be chosen to be too small as this would increase the chance of jams occurring in the corners, and also not be chosen to be too large either as this would increase the chance of sheet edges bending upwards. In a properly functioning embodiment, a radius of 1 mm at the level of the registration panel has been chosen, giving the sheet edge guide a height of 2 mm. Experiments have shown that upward bending of sheet edges occurs infrequently and jamming occurs relatively infrequently.

The present invention also relates to a post-processing station comprising a sheet processing device of this kind. A post-processing station of this kind may conveniently use the benefits of the sheet processing device according to the present invention, allowing a post-processing station according to the present invention to accurately feed sheets onto a stack in a staggered configuration relative to one another, in a productive and reliable manner. A post-processing station of this kind may, for example, consist of a high-capacity stacking device, a binding device or a collecting device to be implemented in a further production process.

BRIEF DESCRIPTION OF THE DRAWINGS

The present invention will now be further explained with reference to the following drawings, wherein.

DETAILED DESCRIPTION OF THE INVENTION

Figure 1:
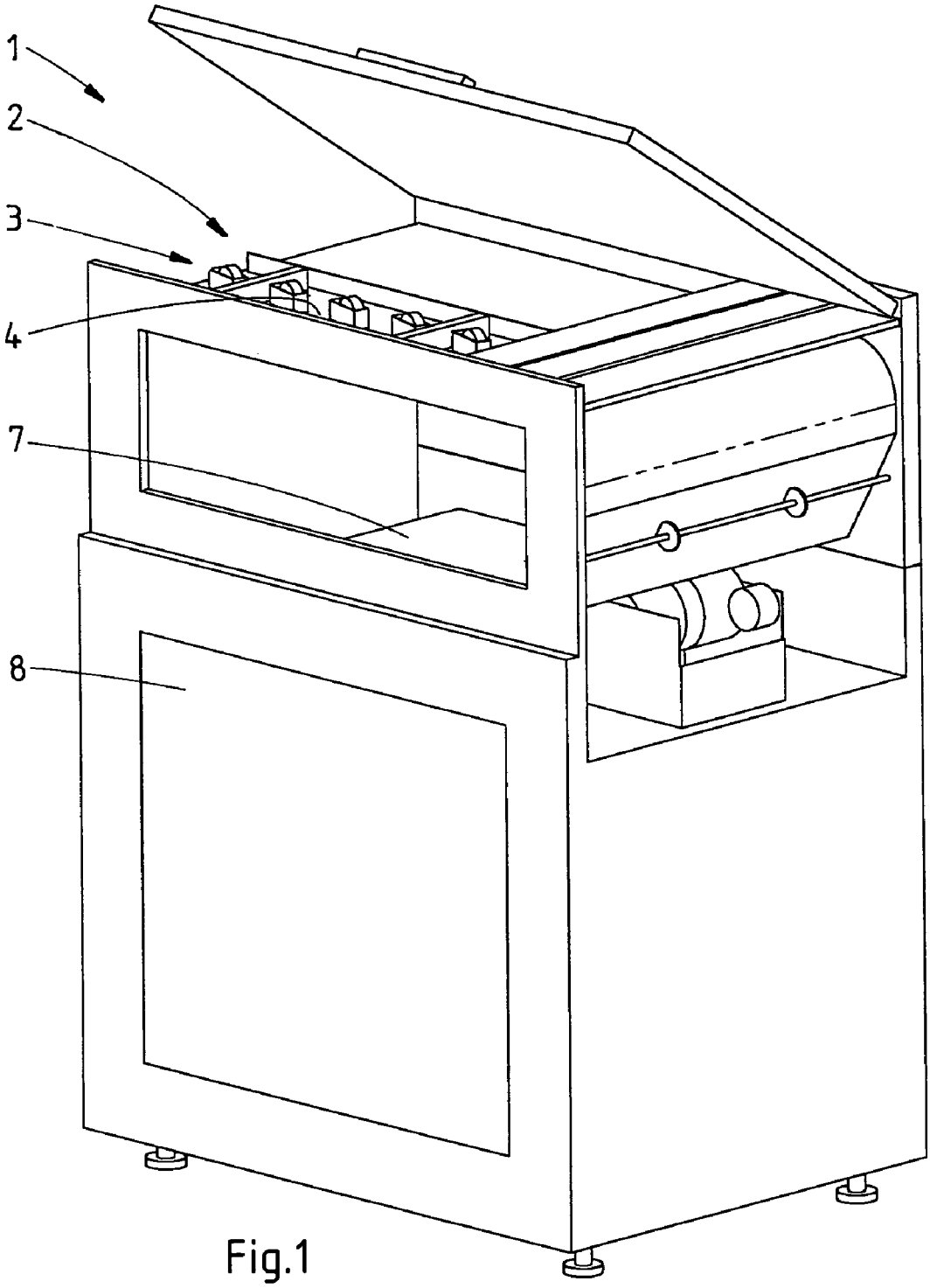
FIG. 1 is a diagram showing a post-processing device according to the present invention.

FIG. 1 is a diagram showing a post-processing station 1 in which a sheet processing device 2 according to the present invention is mounted. In the example shown, post-processing consists of registering incoming sheets and feeding them onto a straight stack. A stacking unit of this kind may, for example, be mounted behind a printer (not shown). By coupling a printer's sheet outlet to entry point 3 of a stacking unit 1 of this kind, sheets from the printer will be stacked neatly while stacking unit 1 performs the registration actions. A stacking unit 1 of this kind may alternatively be embodied with various output facilities, such as, but not limited to, a pallet output facility for easy feeding of stacks from the stacking device onto a pallet, and also a binding facility for binding the stacks together, for example using a plastic strip or another method, in order to maintain the stack shape during transportation.

Figure 2:
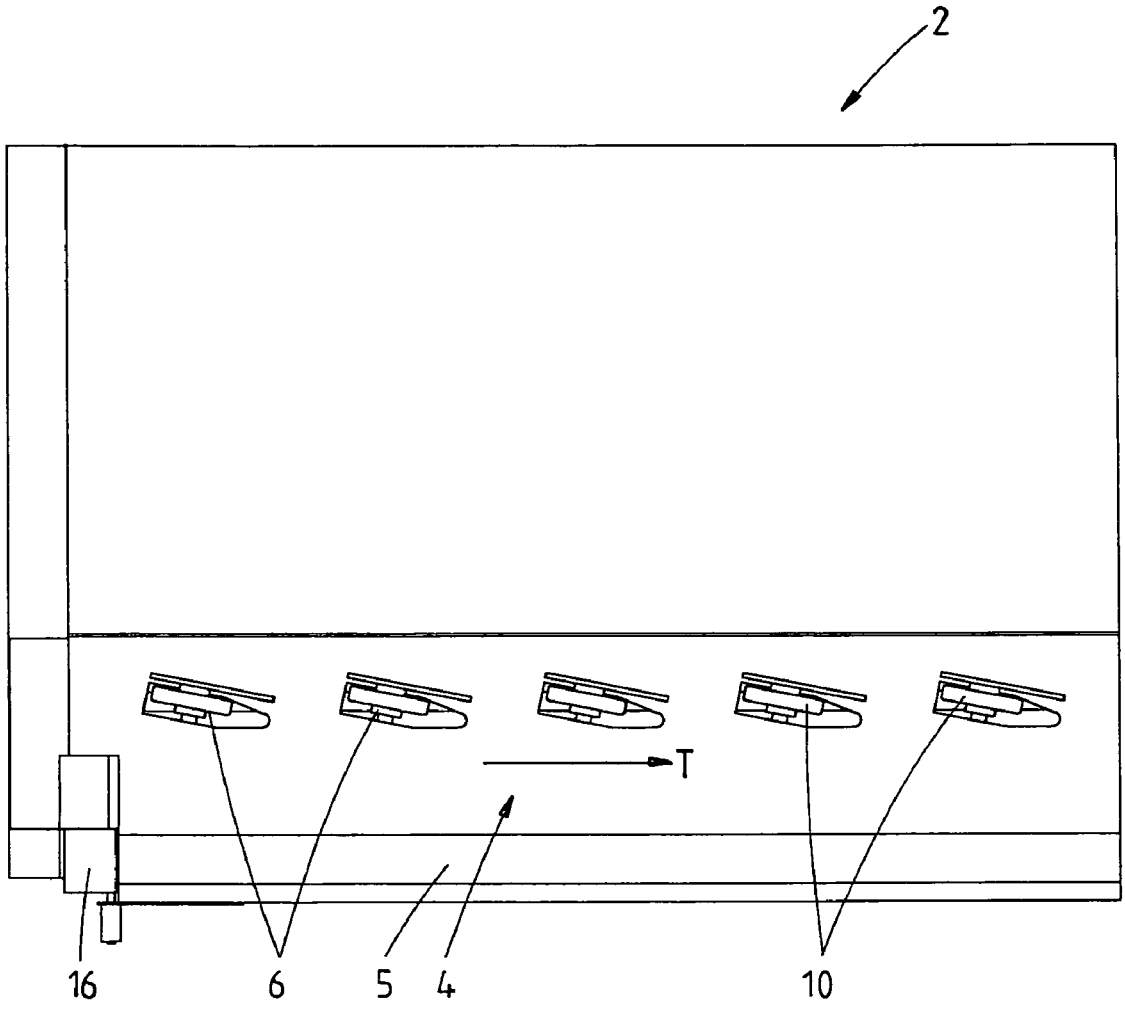
FIG. 2 is a diagram showing a top view of a post-processing station according to the present invention.

Stacking unit 1 as shown in FIG. 1 receives sheets via sheet inlet 3. A sheet that has been fed in is then conveyed against a registration panel 5 by means of a registration ruler 4. A top view of this registration ruler 4 is shown in FIG. 2. In the embodiment shown, transportation clamping arrangements 6 of registration ruler 4 are formed in such a way that a force is transferred from clamping arrangement 6 onto the sheet in the direction of the registration panel 5. As soon as the sheet touches registration panel 5, the force of clamping arrangement 6 on the sheet will predominantly be applied in the direction of transportation T and to a lesser extent in the direction of the registration panel, as sheet deformation may occur if excessive force is applied when a sheet is conveyed against the registration panel 5. This may be achieved by embodying the transportation clamping arrangement 6 of registration ruler 4 with wheels 10 that are more flexible in a first lateral direction than in the other lateral direction. This effect is achieved by modelling transportation wheels 10 as shown in FIGS. 5 or 6. The moment a sheet touches registration panel 5, transportation wheel 10 will bend outwards and transfer a force predominantly directed in the direction of transport T, causing a sheet that has reached registration panel 5 to be pushed against panel 5 without excessive force, thus preventing harmful sheet deformations.

In an alternative embodiment, receiving plane 7 of the device may be height-adjustable, thus allowing the stacking capacity of stacking unit 1 to be increased. The stack may be removed from the unit via an opening hatch or another type of outlet opening 8. Stacking unit 1 may also comprise certain means (not shown) to assist a user in removing the stack from the unit, for example by conveying the stack out of the stacking unit, in whole or in part. In one embodiment, this may be embodied as a power-steered drawer, which, after opening the outlet opening can be conveyed out of the unit. In an alternative embodiment, a stacking unit 1 of this kind may be either electronically connected to a printer, thus allowing the timing of sheets to be communicated, or embodied fully autonomously, where the timing of incoming sheets is detected by the stacking unit 1 itself.

Figure 3:
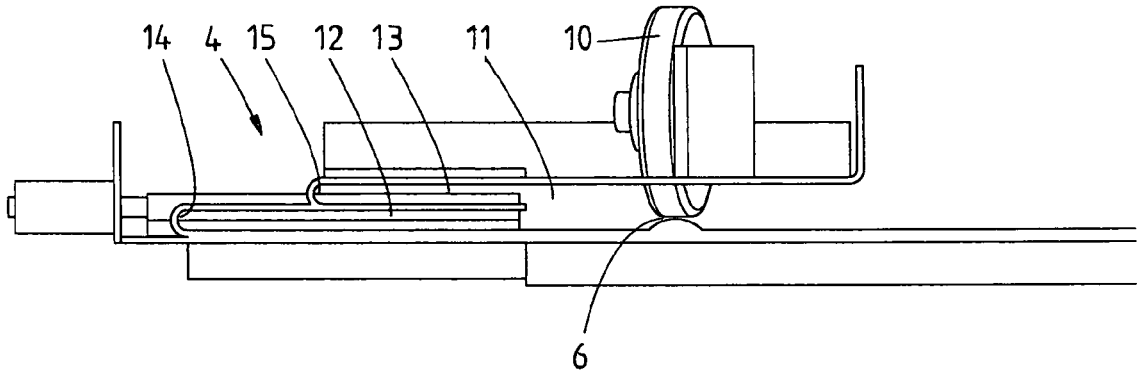
FIG. 3 is a diagram showing a sheet processing device according to the present invention.

In some applications, it is important to be able to easily distinguish various documents or sets of documents. An example of a known method for achieving this consists of collecting the documents in a staggered configuration relative to one another. A set of sheets that go together will then be deposited onto a straight stack, whereas a subsequent stack will receive a divergent, slightly staggered configuration. FIG. 3 is a diagram showing an example according to the present invention where sheets may be deposited onto straight stacks in a staggered configuration relative to one another. In this example shown in front view, a sheet enters stacking unit 1 at the level of sheet inlet 3 and is steered through paper path 11 by drive line 6 in the direction of stops 5, 14 and 15 as described above, and in the feed-through direction T. By steering a sheet edge in a first or second sheet edge guide 12 or 13 respectively upon entry at the level of sheet inlet 3 for example, a sheet is conveyed in the direction of the panel of the selected first or second sheet edge guide 12 or 13 respectively during its transport in the feed-through direction T. As these sheet edge guides 12 and 13 are in a slightly staggered configuration relative to one another, the sheets will receive the lateral registration from selected sheet edge panel 14 or 15. By mounting sheet edge guides 12 and 13 statically onto the frame and conveying the sheet edge into the first or second guide 12 or 13 respectively, a reliable straight stack is formed from sheets subsequently fed through, while the sets are clearly distinguishable relative to one another.

Figure 4:
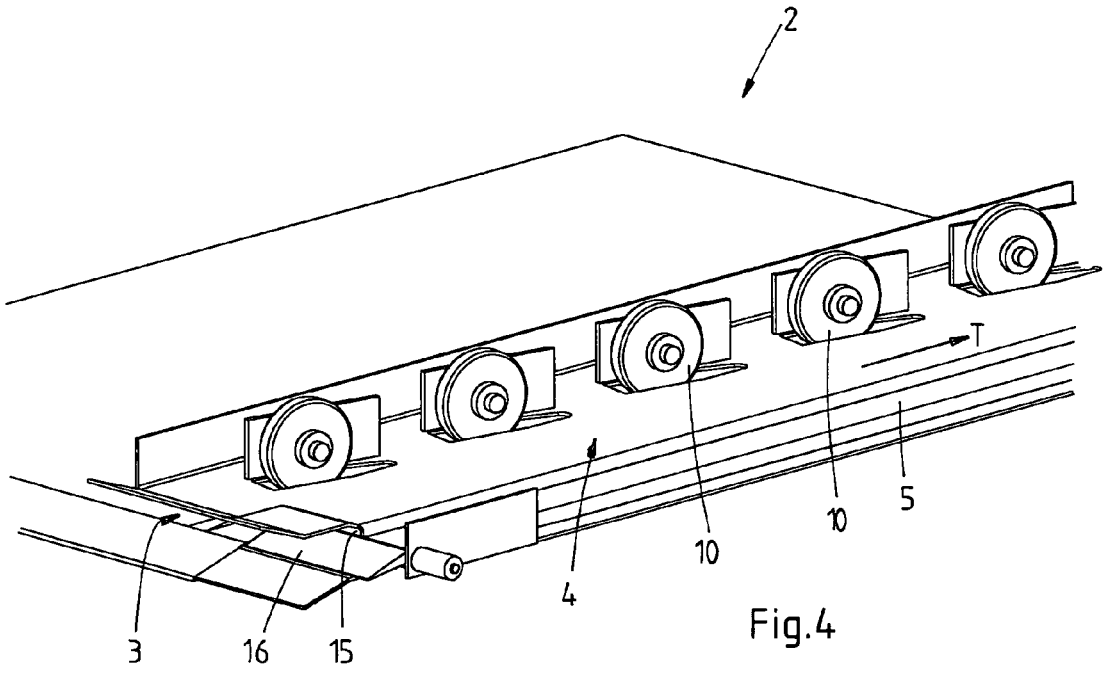
FIG. 4 is a diagram showing a perspective representation of a sheet processing device according to the present invention.
Figure 5A:
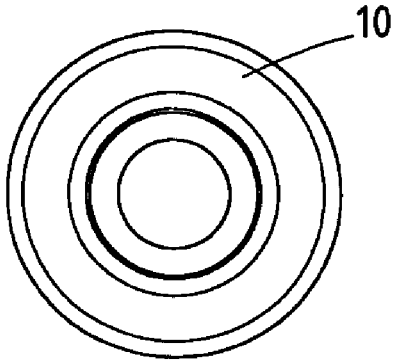
FIGS. 5*a-d* are diagrams showing a side view, front view, cross-section and perspective representation, respectively, of a transportation wheel as may be used in the device according to the present invention.
Figure 5B:
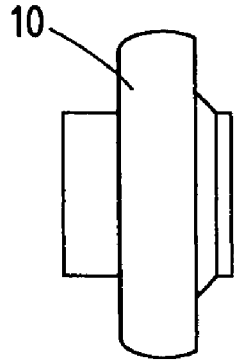
Figure 5C:
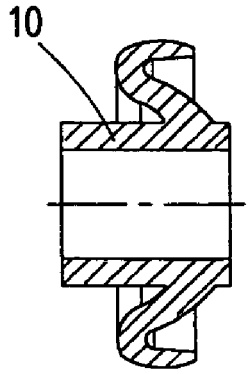
Figure 5D:
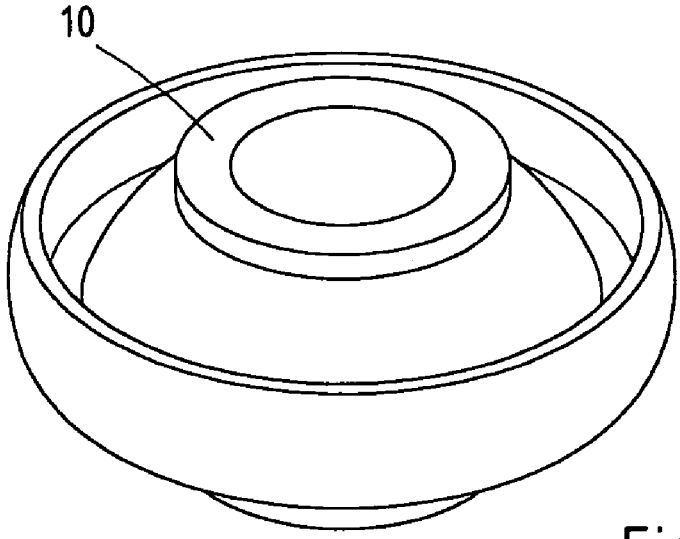

FIG. 4 is a diagram showing an example of a switchable control mechanism 16 that conveys a sheet edge into the first or second sheet edge guide 12 or 13 in a device according to the present invention. In this perspective representation of the device's inlet side 3, a movable flap 16 is located, which conveys a sheet edge into lower guide 12 when configured facing upwards and into upper guide 13 when facing downwards. The orientation of drive line 6 being as described above, a drive action is produced outside of sheet edge guides 12 and 13 in this example, so that the sheet is conveyed into paper path 11 by means of one drive line in the direction of transportation T and in the direction of registration panels 14 and 15. As the paper path 11 is not necessarily split into two paper paths at the level of drive 6, the device does not necessarily require an additional drive line. In one embodiment, the separation of sheet edge guides 12 and 13 may, for example, be achieved by configuring a bent plate in paper path 11, where the radius at the level of the registration panel must not be chosen to be too small as this would increase the chance of jams occurring in the corners, and not too large either as this would increase the chance of sheet edges bending upwards. In a properly functioning embodiment, a radius of 1 mm at the level of the registration panel is chosen, giving the sheet edge guide a height of 2 mm. Experiments have shown that upward bending of sheet edges occurs infrequently and jamming occurs relatively infrequently.

FIGS. 5*a-d* are diagrams showing a side view, front view, cross-section and perspective representation, respectively, of transportation wheel 10. The application of transportation wheels 10 as indicated in FIG. 5 eliminates the absolute necessity of an additional control device to displace the configuration of the registering drive up to the moment the sheet edge touches a registration body 5, 12 or 13. Driven wheels 10 will bend outwards when the sheet touches registration panel 5, 12 or 13, irrespective of the configuration of this panel, so that a sheet will be conveyed against the first or second registration panel 14 or 15 by means of these same driven wheels 10, while the sheet edge does not suffer any damage.

In order to make drive wheels 10 bend outwards more quickly without counteracting the rigidity in the drive direction T, the transport wheels may, in an alternative embodiment, be provided with a number of holes (not shown) in the convex panel that is bending outwards. As a result, the rigidity in the tangential (drive) direction will not decrease or will barely decrease, while the rigidity in the lateral direction bending outwards decreases such that the wheels become more sensitive to the sheet touching registration panel 5, 14 or 15. This will ensure less damage to a sheet as a result of the sheet colliding with the panel or less creasing as a result of excessive pressing against panel 5, 14 or 15.

Figure 6A:
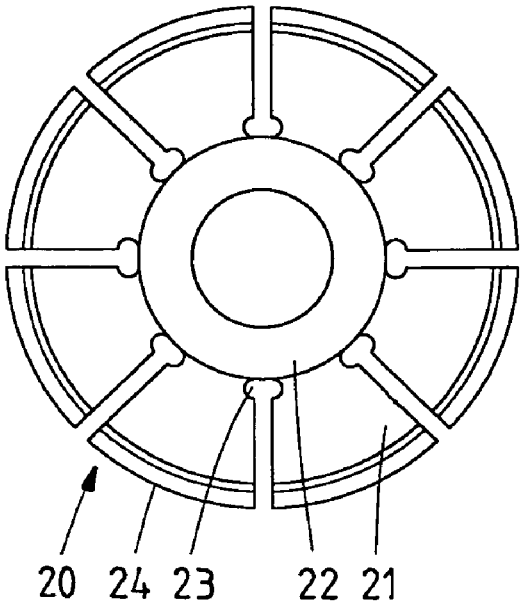
FIGS. 6*a-c* are diagrams showing a side view and cross-section, respectively, of an alternative embodiment of a transportation wheel as may be used in a device according to the present invention.
Figure 6B:
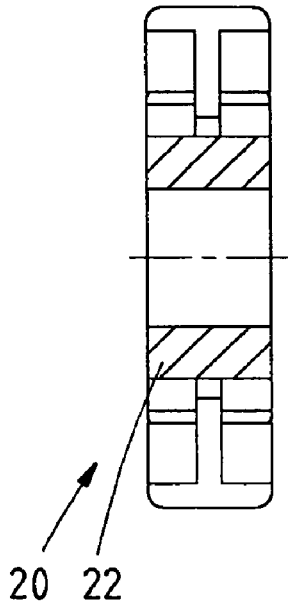
Figure 6C:
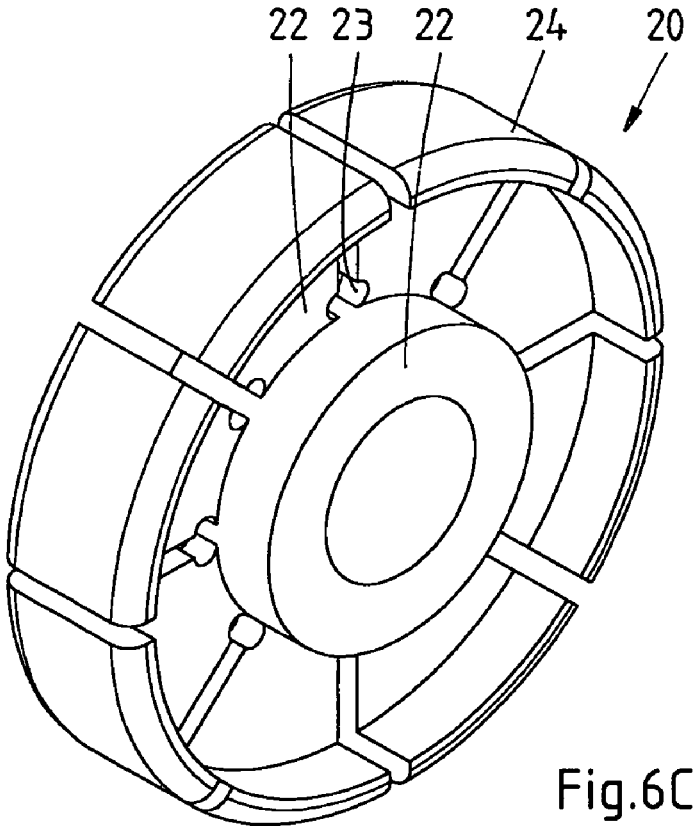

In an alternative embodiment, the driven wheels are shaped as shown in FIG. 6. FIG. 6*a* is a diagram showing a side view and FIG. 6*b* a diagram showing a cross-section. Wheel 20 comprises predominantly T-shaped profiles 21 at the wheel's circumferential edge. These wheels 20 operate in a manner more or less identical to wheels 10 illustrated in FIG. 5, the difference being that wheels 20 shown in FIG. 6 are divided by means of providing cuts into discrete wheel elements 21 that may bend outwards in a lateral direction, independently from one another. Parts 24 of the wheels, which are in contact with the sheet, are shaped such that they may convey the sheet in the feed-through direction T without slipping, whereas elements 21 bending outwards, are insufficiently limited in their rigidity to cause wheel parts 21 to bend outwards laterally when a sheet touches a registration panel, so that a sufficiently low lateral force component is exerted onto the sheet in this situation and the sheet is not damaged. Sides 24 of the wheel parts that come into contact with the sheets to be conveyed during operation are, for example, predominantly flat, rounded off or convex in the direction of the sheet.

In the transportation wheels as shown in FIG. 6, the sawing cuts at the level of base 22 may be fitted with borings 23 or may be rounded off. This is convenient to prevent undesirable tearing of wheel parts 21 and to further enhance the flexibility of parts 21 bending laterally outwards.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

The invention claimed is:

1. A sheet processing device wherein sheets following one another in succession may be deposited in a staggered configuration relative to one another which comprises:

a paper path, a first and second sheet edge guide fitted substantially parallel to one another in a feed-through direction, and a transportation device arranged to convey a sheet through the paper path in the feed-through direction and the lateral direction, wherein the first and second sheet edge guides are arranged statically relative to the paper path and in a staggered configuration relative to one another in the lateral direction, and a switchable control mechanism is fitted to adopt a first and second configuration, allowing only the sheet edge of a sheet to be conveyed into the first and second sheet edge guides, respectively, during operation.

2. The sheet processing device according to claim 1, wherein the control mechanism comprises a movable flap fitted at the entry point to the paper path.

3. The sheet processing device according to claim 1, wherein the transportation device comprises at least one driven wheel configured such that the drive direction is at an angle of 0-90° to the feed-through direction (T) in the paper path plane.

4. The sheet processing device according to claim 3, wherein the driven wheel has a bend rigidity in the lateral direction such that the driven wheel bends outwards during operation when a sheet touches the registration panel.

5. The sheet processing device according to claim 1, wherein the sheet edge guides are shaped as U profiles.

6. A post-processing station comprising the sheet processing device according to claim 1.

7. The sheet processing device according to claim 1, wherein the switchable control mechanism includes a movable flap which conveys a sheet edge into a lower guide when configured facing upwards and into an upper guide when facing downwards.

* * * * *